United States Patent [19]

Hendricks

[11] 4,305,773

[45] Dec. 15, 1981

[54] ART RESTORATION TABLE

[76] Inventor: Richard O. Hendricks, 3914 E. 34th St., Tulsa, Okla. 74135

[21] Appl. No.: 100,194

[22] Filed: Dec. 4, 1979

[51] Int. Cl.[3] ..... B32B 35/00

[52] U.S. Cl. ..... 156/382; 100/295; 156/64; 156/94; 156/285; 156/379; 156/583.3; 264/36; 264/101; 427/140

[58] Field of Search ..... 100/93 P, 295; 156/285, 156/286, 382, 583.1, 64, 379, 94, 583.3; 264/36, 101; 422/900; 427/140, 296, 297, 377

[56] References Cited

U.S. PATENT DOCUMENTS 3,738,890 6/1973 Johnson et al. ..... 156/382 X
4,251,314 2/1981 Johnston ..... 156/583.1

OTHER PUBLICATIONS

Duane F. Merrill, "Restoring Works of Art with Silicone PSA's", *Adhesives Age,* vol. 24, No. 2 (Feb. 1981) pp. 39–41.

*Primary Examiner*—Robert A. Dawson
*Attorney, Agent, or Firm*—Head & Johnson

[57] ABSTRACT

A restoration apparatus for restoring a painting and bonding a canvas backing to a painting having a panel member and a frame attached thereon. A flexible mat is stretched over the frame to form an airtight chamber which is in communication with a source of vacuum. A planar heating device is yieldably disposed over said mat. The heating device is comprised of a clear glass panel with heating elements in contact therewith. A heating control means is in communication with the heating device.

4 Claims, 4 Drawing Figures

ART RESTORATION TABLE

BACKGROUND OF THE INVENTION

1. Field of the Invention

The present invention relates to an art restoration table and, more particularly, to such a table which utilizes a vacuum pump to facilitate the restoration of the painting as well as a transparent glass heating element which allows visual inspection of the restoration process.

2. Description of the Prior Art

Older paintings oftentimes will have surface irregularities such as cracks or loss of the paint caused by abuse or simple deterioration over the years. It is desirable to restore these paintings by providing them with a new canvas backing to provide support and to impregnate the painting with a resin to prevent further cracking. In the past, an old painting which was to be restored would be placed on a table face down, have a layer of adhesive spread over the back thereof and then have a new canvas backing attached thereto. A heated iron would be drawn across the backside of the canvas to heat the adhesive. This method is difficult to use and has numerous disadvantages, such as, the adhesive is generally not applied evenly, there is uneven heat distribution which causes sudden changes in tension in adjacent fields or areas of the paintings and the hot, heavy ironing necessary causes damage to the impasto or surface relief of the painting.

Heated Restoration tables have been developed which heat the new and old canvasses and at the same time place the canvasses within a partial vacuum causing the adhesive to penetrate the old canvas to provide a smooth and even distribution of the adhesive. This vacuum table method overcomes a great majority of the disadvantages of using the cold table method, however, major disadvantages and problems still remain. There is no way to visually inspect the canvasses while the restoration process is taking place to ensure that no air bubbles form between the canvasses and to ensure that the adhesive has sufficiently penetrated the painting.

SUMMARY OF THE INVENTION

The present invention generally provides a restoration apparatus which overcomes the disadvantages of prior art vacuum restoration tables. The present invention provides a means for visual inspection of the restoration process while taking place so as to ensure the proper restoration of a painting. The present invention greatly reduces the potential for damage to a painting during restoration as caused by bubbles forming between the canvasses and insufficient heat or time to ensure proper restoration.

The restoration apparatus is comprised of a planar panel which has a frame attached thereto. A flexible mat is stretched over the frame to form an airtight chamber which is in communication with a source of vacuum. A planar heating device is yieldably disposed above the mat and can be constructed from clear glass with heating elements embedded therein or thereon.

A painting to be restored is placed in contact with a new canvas, which has adhesive spread thereover. The painting and the canvas are sandwiched between layers of tissue paper and plastic sheeting and on top of the mat. The heating device is lowered over the painting and heat is applied thereto while a vacuum is applied also. The restoration process is accomplished when the colors of the painting clearly show through the new adhesive saturated tissue paper as determined by visual inspection through the clear glass heating device.

DETAILED DESCRIPTION OF THE PREFERRED EMBODIMENTS

Figure 1:
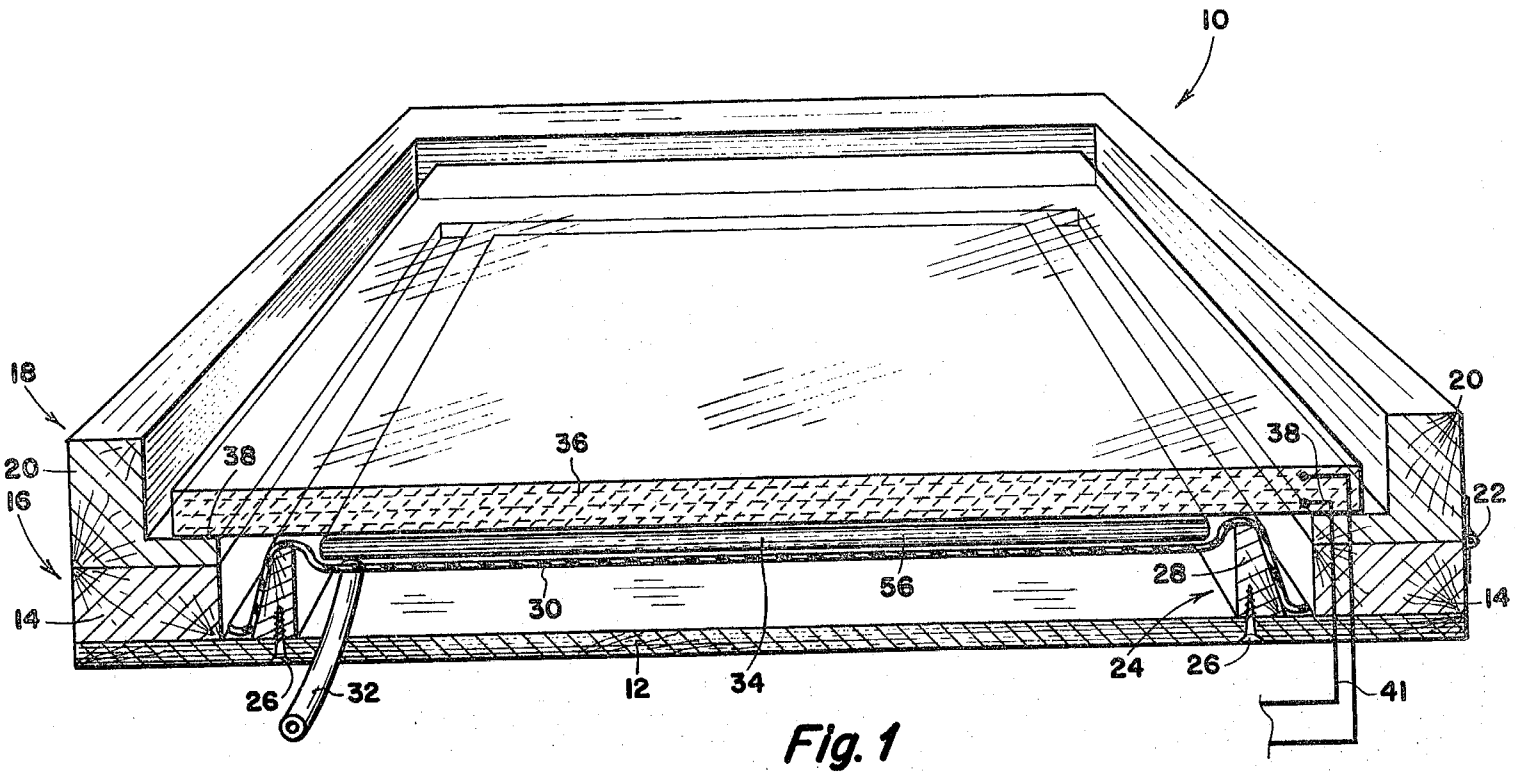
FIG. 1 is a perspective view of an art restoration table embodying the present invention.

Referring to the drawings in detail, reference character 10 generally indicates an art restoration table particularly designed for the restoration of old paintings and for applying a new canvas backing to a painting. As shown in FIG. 1, the art restoration table 10 is generally rectangular in shape and is primarily constructed of wood or other similar material. The restoration table 10 is provided with a rectangular bottom panel 12 and a plurality of rectangular members 14 which are attached to the bottom panel 12 around the peripheral edge thereof to form a rectangular frame 16. A top frame 18 is constructed of "L"-shaped members 20 and is yieldably attached to the frame 16 by means of a plurality of hinges 22. An inner rectangular frame 24 is attached to the bottom panel 12 by means of a plurality of screws 26 and is of a smaller overall dimension than the frame 16 so as to provide a space therebetween. The frame 24 is comprised of a plurality of triangular shaped members 28 with a rubber mat 30 stretched across the frame 24. The mat 30 is glued or attached to the members 28 to form an airtight seal. The junction of the frame 24 and the bottom panel 12 is filled with glue to form an airtight seal. A flexible hose 32 extends through an opening (not shown) in the frame 16 into a space 34 between the mat 30 and the bottom panel 12. A vacuum pump (not shown) withdraws air from the space 34 through the tube 32 as will be described in more detail hereinbelow.

Figure 2:
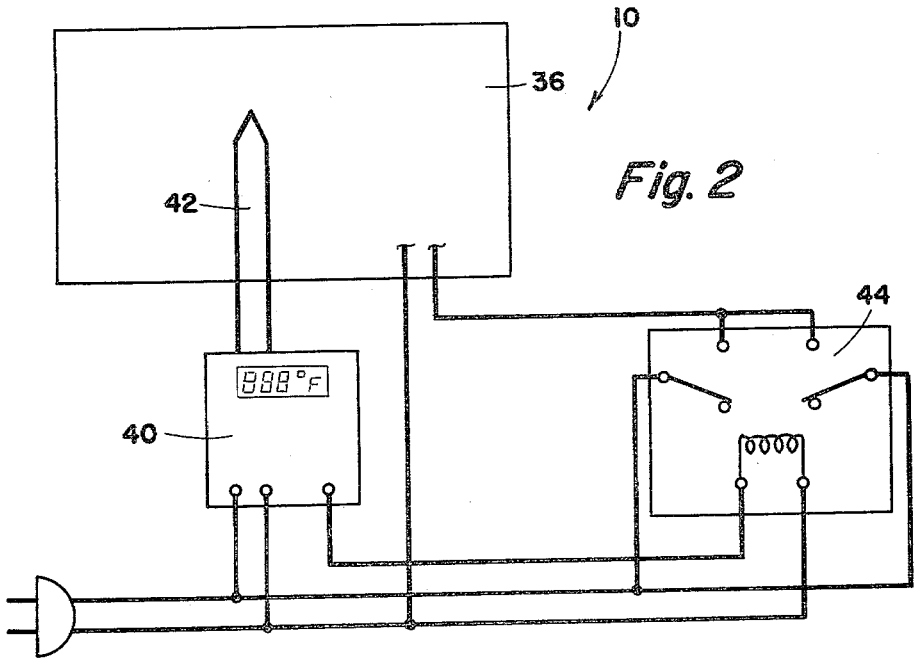
FIG. 2 is an electrical diagram of the heating circuitry of the present invention.

A plate of glass 36 fits within the top frame 18 and rests on top of a shoulder portion 38 of the "L"-shaped members 20. The plate 36 is made from clear glass approximately one-quarter of an inch thick or thicker depending on the overall size of the glass 36 and is provided with heating elements (not shown) lamenated on top of or within the plate 36. As shown in FIG. 2, the heating of the plate 36 is controlled by an adjustable heat controller 40, such as an Omega Engineering Company Digital Controller No. 400 IJF or equivalent through cables 41 which are attached to the heating elements. The controller 40 is in communication with a heat sensor 42 which is embedded in the plate 36. When the desired temperature of the plate 36 is reached, as determined by the heat sensor 42, the controller 40 energizes a relay 44 which in turn stops the flow of electrical current to the heating elements within the plate 36. As can be seen, the controller 40, in combination with the sensor 42 and the relay 44, maintains the plate 36 at the desired temperature.

Figure 3:
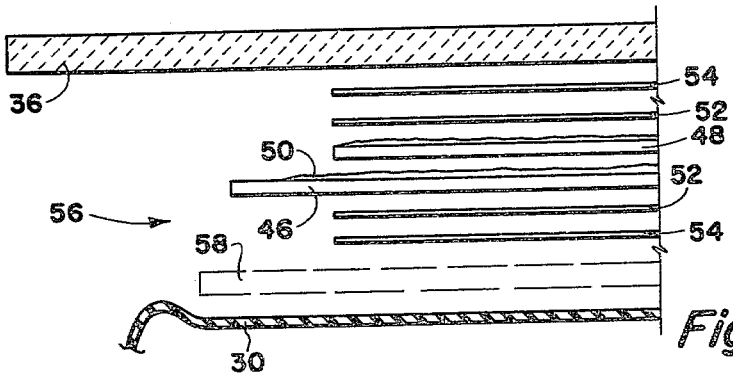
FIG. 3 is a semi-diagramatic side view of an old canvas to be restored and a new canvas with layers of material needed for the restoration process on either side thereof.

The art restoration table 10 primarily used for restoring old or damaged paintings by impregnating the painting with a resin made from refined beeswax, thick turpentine (or equivalent emulsion), to prevent cracking and attaching a new canvas backing to the painting. As shown in FIG. 3, a new canvas 46 which is to be joined to the back of an older painting 48 is comprised of canvas which is stretched over a frame (not shown) and which is approximately 2" greater in length and width than the old painting 48 which is to be restored. The top side of the new canvas 46 has a wax adhesive 50 spread thereover. The adhesive 50 is compose of damar resin, refined beeswax, and thick turpentine (or equivalent emulsion) and is evenly spread over the canvas 46 and preheated to form a smooth, even surface. The backside of the painting 48 is coated with a thin layer of wax, rosin and balsam, then the old painting 48 and the new canvas 46 are sandwiched between layers of tissue paper 52, such as "Mulberry" brand wrapping tissue paper, and a sheet of clear, thin plastic 54. The old painting 48 and the canvas 46 and the tissue paper layer 52 and layers of plastic 54 form a painting unit 56. The top frame 18 is lifted upwards and the art unit 56 is placed on top of the mat 30 and the frame 18 is then lowered thereupon. The art unit 56 may be placed on top of a layer of foam rubber 56 which provides additional cushioning. The controller 40 is adjusted to the desired temperature which heats the plate 36. A vacuum is applied through the hose 32. The heat and vacuum causes the resin adhesive to penetrate the old painting 48. The heat and vacuum are maintained until the adhesive 50 bleeds through the painting 48 and the tissue paper 52. The operator watches the restoration process through the clear plate 36 and when the colors of the painting 48 clearly appear through the top tissue layer 52 the restoration process is finished. The new canvas 46 has been bonded to the old painting 48 and the rosin adhesive 50 has penetrated the painting 48 to provide a durable and non-cracking surface thereon. The art unit 56 is allowed to completely cool and then is removed, cleaned and framed.

Figure 4:
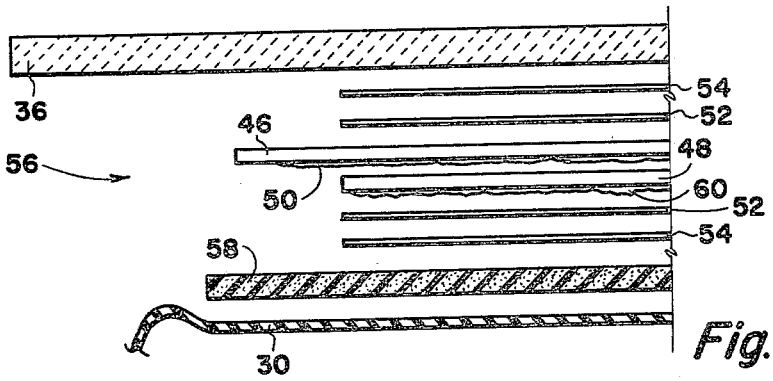
FIG. 4 is a view similar to FIG. 3, but showing the arrangement of the canvasses for the restoration of a painting with large amounts of surface relief or impasto.

When paintings are used with thick layers of paint such as impasto or pallet work 60, as shown in FIG. 4, the painting to be restored 48 is placed facedown with the new canvas 46 placed thereabove so that when the heating takes place the impasto 60 will not be damaged or presses as might occur is the paintings were placed in the configuration as shown in FIG. 3.

The art restoration table 10 with the clear plate 36 provides a novel and useful means for restoring art work which is quick and easy but also provides a means for visual inspection to ensure the proper restoring of the paintings without the trial and error methods previously used.

Whereas the present invention has been described in particular relation to the drawings attached hereto, it should be understood that other and further modifications of the invention, apart from those shown or suggested herein, may be made within the scope and spirit of this invention.

What is claimed is:

1. A restoration apparatus for restoring a painting being comprised of:

a planar glass panel member positioned within a frame;

a flexible mat stretched over and attached to said frame to form an airtight chamber relative to one side of said glass panel within which chamber said painting is situated;

a vacuum means in communication with said airtight chamber;

heating means in contact with said glass panel; and means to adjustably control the temperature of said heating means.

2. A restoration apparatus for bonding a canvas backing to a painting being comprised of:

a planar glass panel member positioned within a frame;

a flexible mat stretched over and attached to said frame to form an airtight chamber relative to one side of said glass panel within which chamber said painting and canvas backing are situated;

a vacuum means in communication with said airtight chamber;

planar heating means in contact with said glass panel; and means to adjustably control the temperature of said heating means.

3. A restoration apparatus as set forth in claim 1 or 2 wherein said glass panel is clear.

4. A restoration apparatus as set forth in claim 1 or 2 wherein said heating means are spaced within said glass panel.

* * * * *